US006612884B2

(12) United States Patent
Wada et al.

(10) Patent No.: US 6,612,884 B2
(45) Date of Patent: Sep. 2, 2003

(54) NEGATIVE INTAKE PRESSURE DETECTION SYSTEM IN OUTBOARD MOTOR

(75) Inventors: Tetsu Wada, Saitama (JP); Tomonori Ikuma, Saitama (JP); Kazuyoshi Sato, Saitama (JP)

(73) Assignee: Honda Giken Kogyo Kabushiki Kaishha, Tokyo (JP)

( * ) Notice: Subject to any disclaimer, the term of this patent is extended or adjusted under 35 U.S.C. 154(b) by 0 days.

(21) Appl. No.: 10/073,273

(22) Filed: Feb. 13, 2002

(65) Prior Publication Data

US 2002/0119713 A1 Aug. 29, 2002

(30) Foreign Application Priority Data

Feb. 14, 2001 (JP) ..... 2001-037743

(51) Int. Cl.[7] ..... B63H 21/10

(52) U.S. Cl. ..... 440/88; 440/1

(58) Field of Search ..... 440/1, 88

(56) References Cited

FOREIGN PATENT DOCUMENTS

JP 5-106501 4/1993

*Primary Examiner*—Jesus D. Sotelo
(74) *Attorney, Agent, or Firm*—Arent Fox Kintner Plotkin & Kahn, PLLC

(57) ABSTRACT

An outboard motor is provided which includes, in an engine compartment defined by an engine hood, an engine, an intake manifold including a plurality of intake branch pipes connected to a plurality of intake ports of the engine, and a throttle body connected to an intake inlet of the intake manifold. A negative pressure detection hole that opens within the intake manifold, is provided in the outer wall of the intake manifold, and a negative intake pressure sensor that is fixed to the outer wall is positioned in the negative pressure detection hole.

1 Claim, 16 Drawing Sheets

NEGATIVE INTAKE PRESSURE DETECTION SYSTEM IN OUTBOARD MOTOR

BACKGROUND OF THE INVENTION

1. Field of the Invention

The present invention relates to a negative intake pressure detection system in an outboard motor that includes, in an engine compartment defined by an engine hood, an engine, an intake manifold having a plurality of intake branch pipes connected to a plurality of intake ports of the engine, and a throttle body connected to an intake inlet of the intake manifold, wherein the negative intake pressure that is used as a control signal for the engine is detected via the intake manifold.

2. Description of the Prior Art

An outboard motor in which, in order to detect the engine negative intake pressure, a negative pressure detection hole is provided in a pipe wall of an engine intake pipe, one end of a connecting hose is connected to the hole, and the other end of the hose extends and is connected to a negative intake pressure sensor installed in an engine control unit, is known in, for example, Japanese Patent Application Laid-open No. 5-106501.

This conventional negative intake pressure detection system in an outboard motor, since a comparatively long connecting hose is needed, the responsiveness of the negative intake pressure sensor to the change in engine negative intake pressure cannot be said to be good. Furthermore, manipulating a long connecting hose in the cramped engine compartment of an outboard motor undesirably degrades the ease of assembly and maintenance to some extent.

SUMMARY OF THE INVENTION

The present invention has been carried out in view of the above-mentioned circumstances, and it is an object of the present invention to provide a negative intake pressure detection system in an outboard motor that does not require a connecting hose and can detect the negative intake pressure of an engine with high responsiveness.

In order to achieve the object, in accordance with one aspect of the present invention, a negative intake pressure detection system is provided in an outboard motor that includes, in an engine compartment defined by an engine hood, an engine, an intake manifold including a plurality of intake branch pipes connected to a plurality of intake ports of the engine, and a throttle body connected to an intake inlet of the intake manifold. A negative pressure detection hole that opens within the intake manifold, is provided in the outer wall of the intake manifold, and a negative intake pressure sensor that is fixed to the outer wall, is fitted in the negative pressure detection hole.

In accordance with this arrangement, since the negative intake pressure sensor directly detects the negative intake pressure generated within the intake manifold, the responsiveness of the negative intake pressure sensor to a change in the negative intake pressure of the engine can be enhanced. Moreover, the interior of the intake manifold functions as a surge tank, thereby leveling the intake pulsations of the engine, and as a result the negative intake pressure sensor can detect the negative intake pressure precisely.

Furthermore, since, unlike the prior art arrangement, it is unnecessary to employ a long connecting hose and thus, the ease of assembly and maintenance of the engine can be enhanced.

DETAILED DESCRIPTION OF THE PREFERRED EMBODIMENTS

In the explanation below, the terms 'front' ('forward'), 'rear' ('reverse'), 'left', and 'right' are used with reference to a hull H on which an outboard motor O is mounted.

Figure 1:
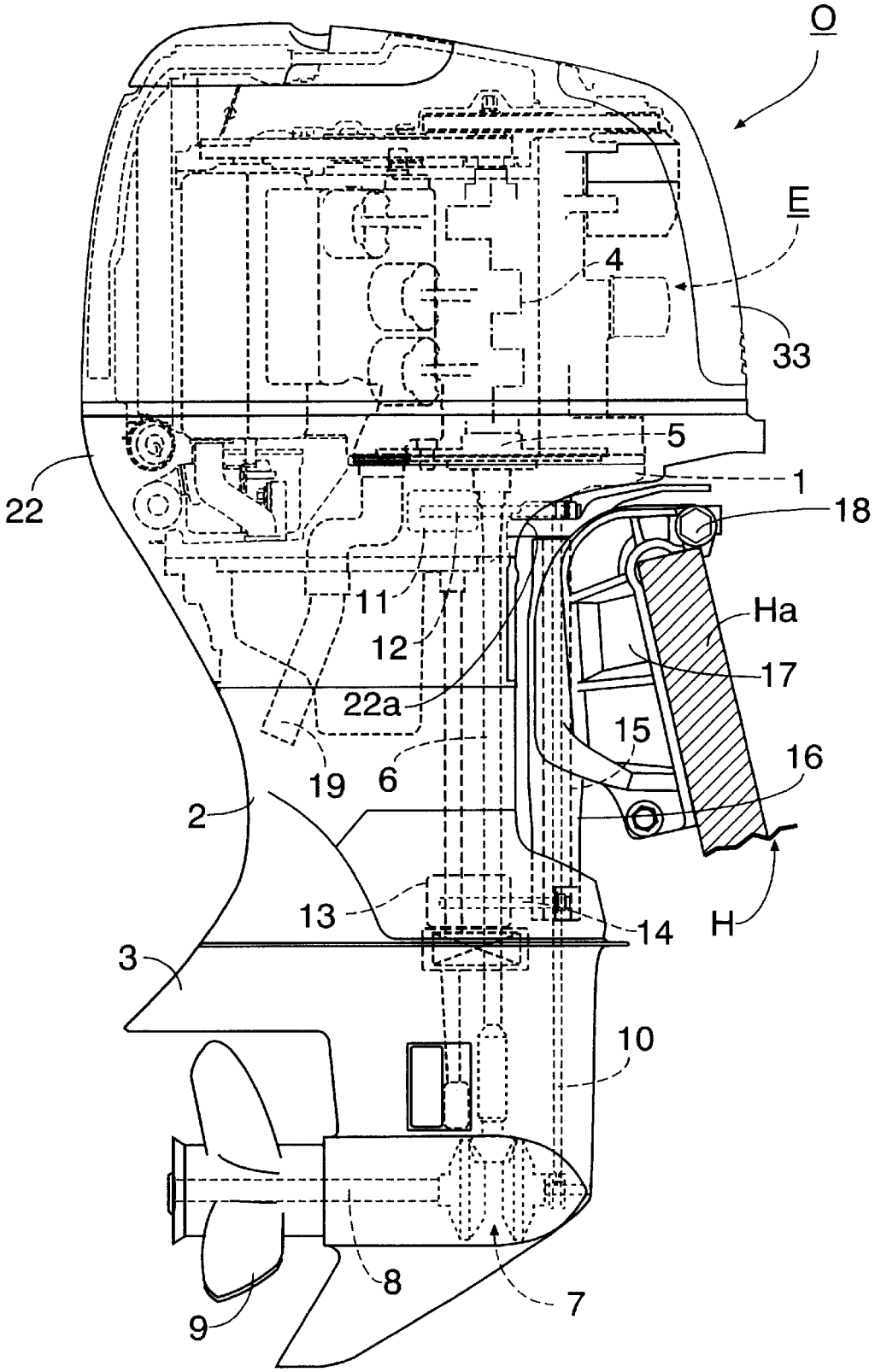
FIG. 1 is a side view of an outboard motor.
Figure 2:
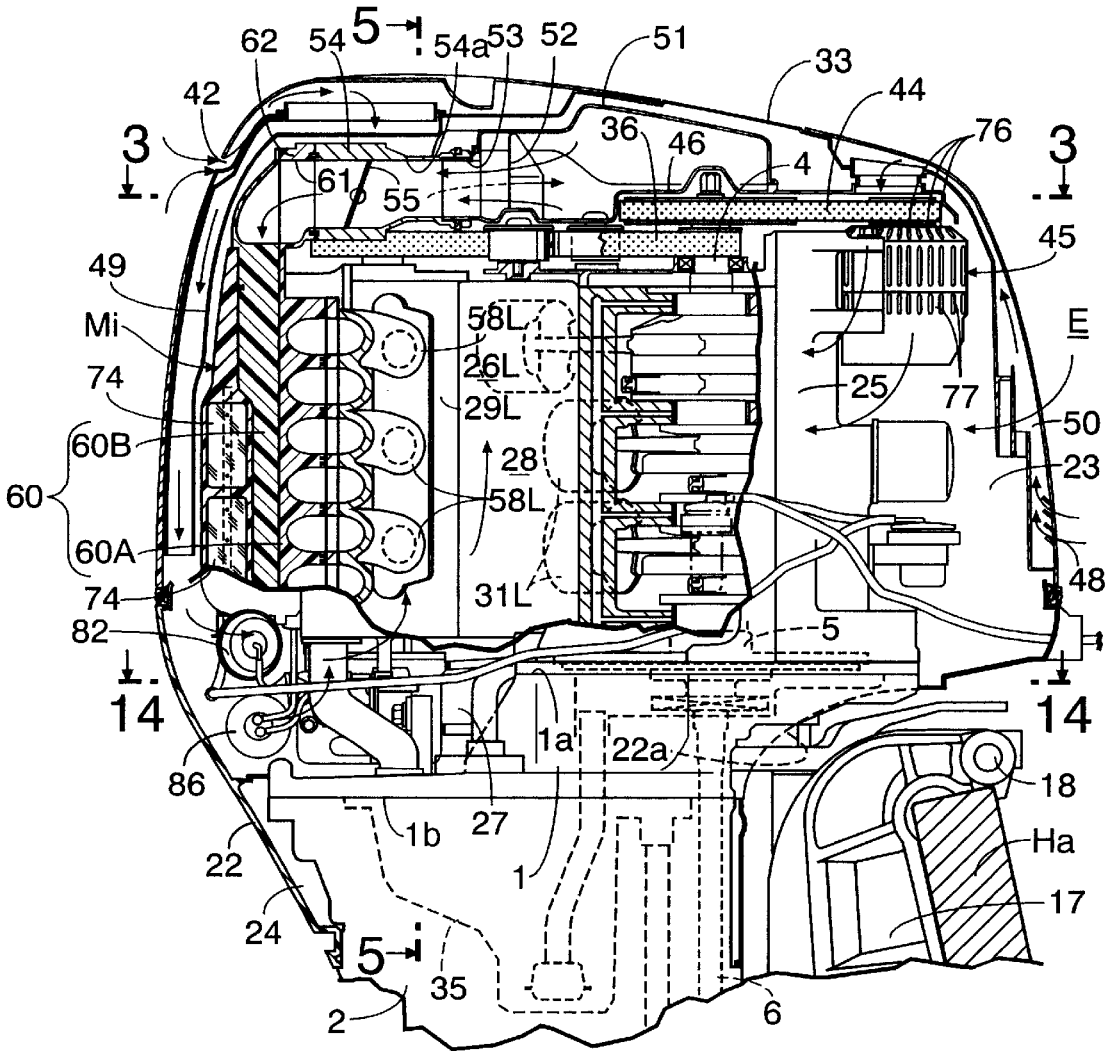
FIG. 2 is a longitudinal cross section of an essential part of FIG. 1.

In FIGS. 1 and 2, the outboard motor O includes a mount case 1, an extension case 2 that is joined to the lower end face of the mount case 1, and a gear case 3 that is joined to the lower end face of the extension case 2. A V6 water-cooled four-stroke engine E is mounted on the upper end face of the mount case 1 so that a crankshaft 4 is vertical.

The lower end of the crankshaft 4 is linked to a drive shaft 6 as well as to a flywheel 5. The crankshaft 4 extends downward within the extension case 2. Its lower end is connected to a horizontal propeller shaft 8 via a forward/reverse switch-over mechanism 7 provided within the gear case 3. A propeller 9 is fixed to the rear end of the propeller shaft 8. Linked to a front part of the forward/reverse switch-over mechanism 7 is a change rod 10 for operating the mechanism 7.

A swivel shaft 15 is fixed between a pair of left and right upper arms 12 and a pair of left and right lower arms 14. The pair of upper arms 12 are linked to the mount case 1 via an upper mount rubber 11. The pair of lower arms 14 are linked to the extension case 2 via a lower mount rubber 13. A swivel case 16 rotatably supports the swivel shaft 15 and is supported in a vertically swingable manner by a stern bracket 17 mounted on a transom Ha of the hull H via a horizontal tilt shaft 18.

The mount case 1 is also provided, via a plurality of stays 21, with a bracket 20 surrounding the lower part of the engine E. Fixed to the bracket 20 is an annular under cover 22 made of a synthetic resin. This under cover 22 covers the periphery of the section between the lower part of the engine E and the upper part of the extension case 2. Mounted detachably on the upper end of the under cover 22 is an engine hood 33 covering the engine E. The engine hood 33 and the under cover 22 define an engine compartment 23 for housing the engine E. The under cover 22 defines an annular empty chamber 24 between itself and the outer periphery of the upper part of the extension case 1. The under cover 22 has, on its front part, a cutout 22*a* through which the empty chamber 24 is connected to the outside air. The upper arms 12 pass through the cutout 22*a*.

Figure 3:
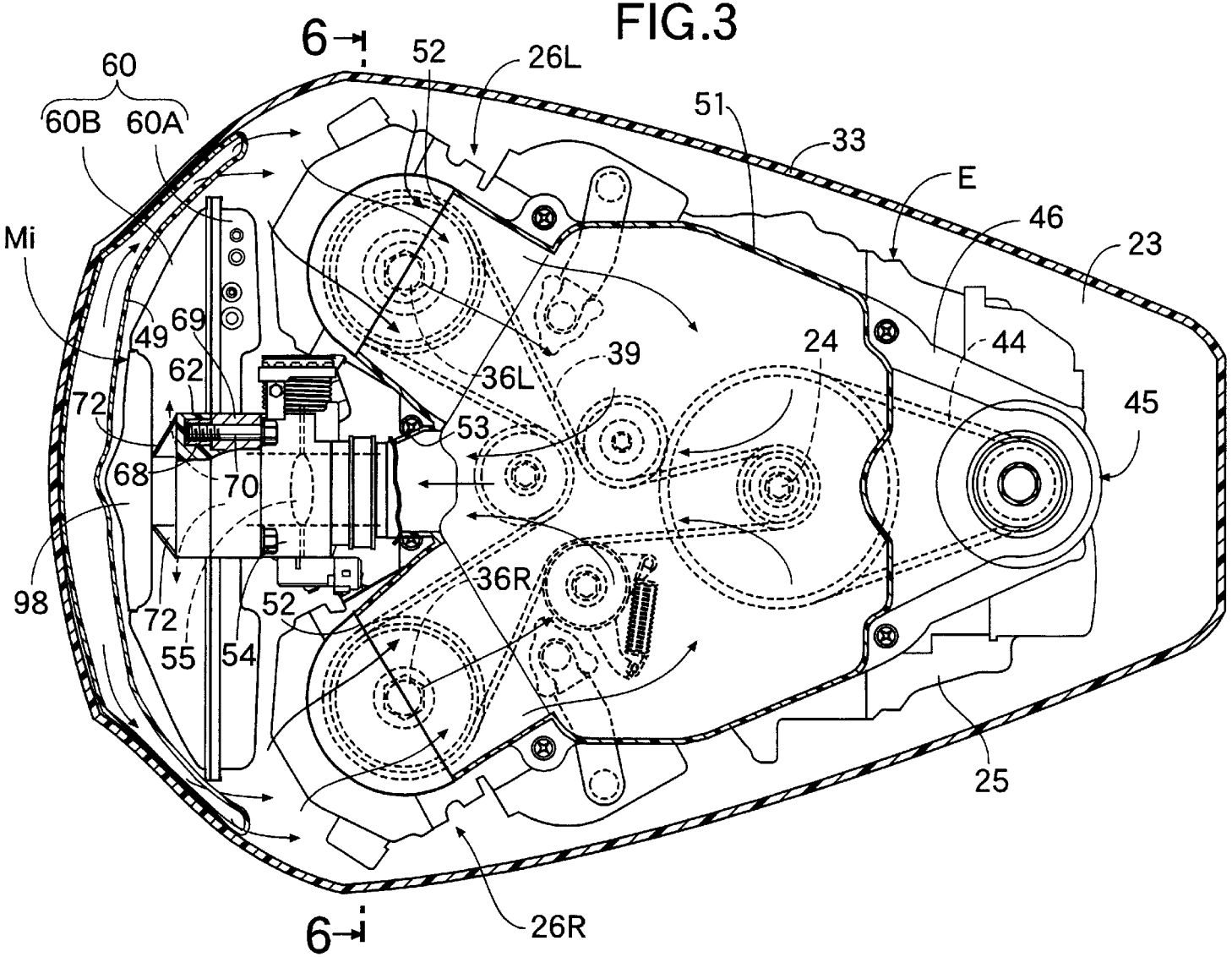
FIG. 3 is a cross section at line 3—3 in FIG. 2.
Figure 4:
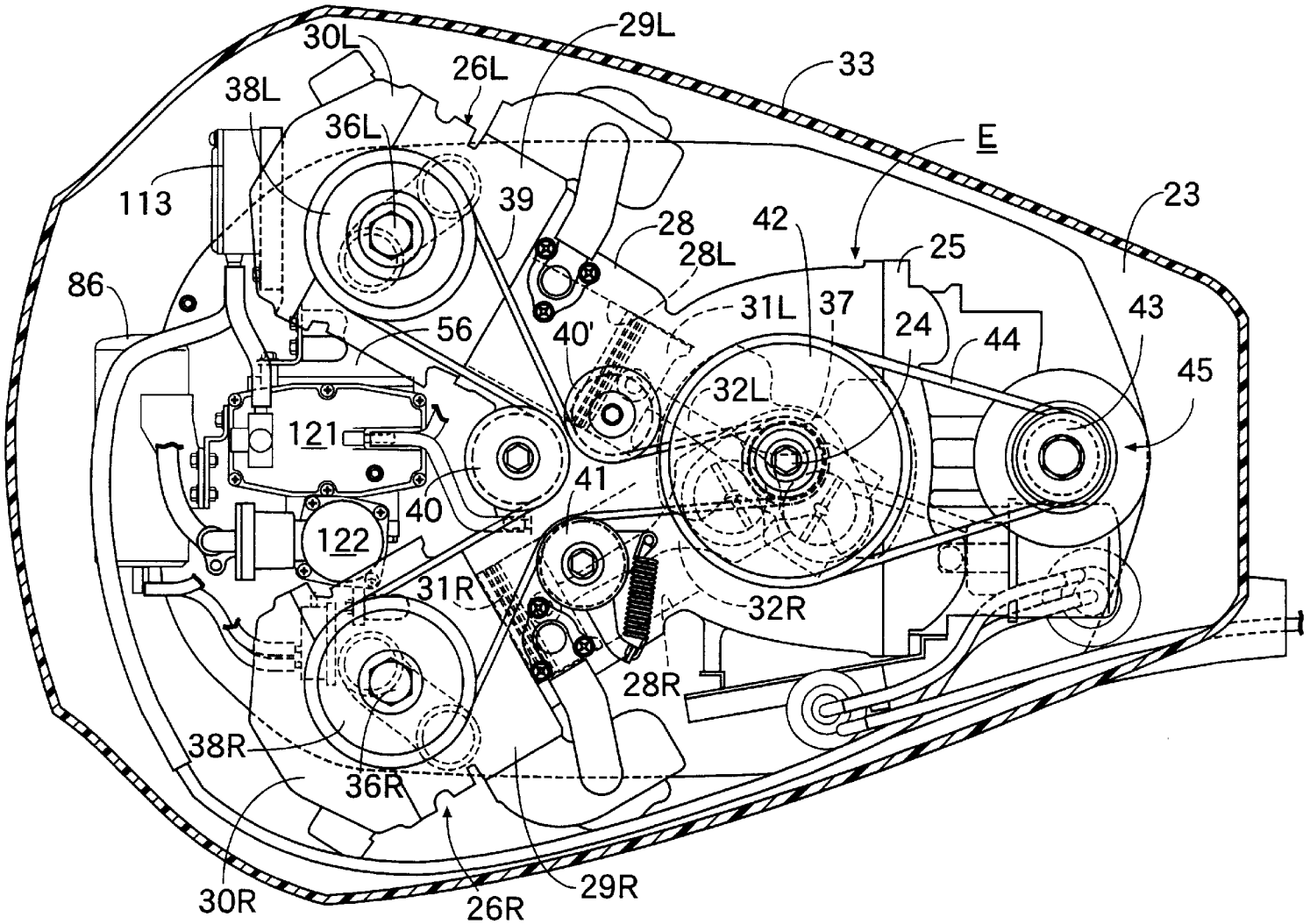
FIG. 4 is a plan view showing a state of FIG. 3 in which the intake system has been removed.

As shown in FIGS. 2 to 4, the engine E has a crankcase 25 supporting the vertically mounted crankshaft 4, and a pair of left and right banks 26L and 26R, which extend to the rear in a V-shaped manner from the crankcase 25. The lower face of the crankcase 25 is bolted to an upper mounting face 1*a* (FIG. 13) of the mount case 1. The upper mounting face 1*a* of the mount case 1 is formed to be higher and offset forward relative to the other upper face of the mount case 1, thereby defining an supplementary equipment installation space 27 between the left and right banks 26L, 26R and the mount case 1.

Figure 5:
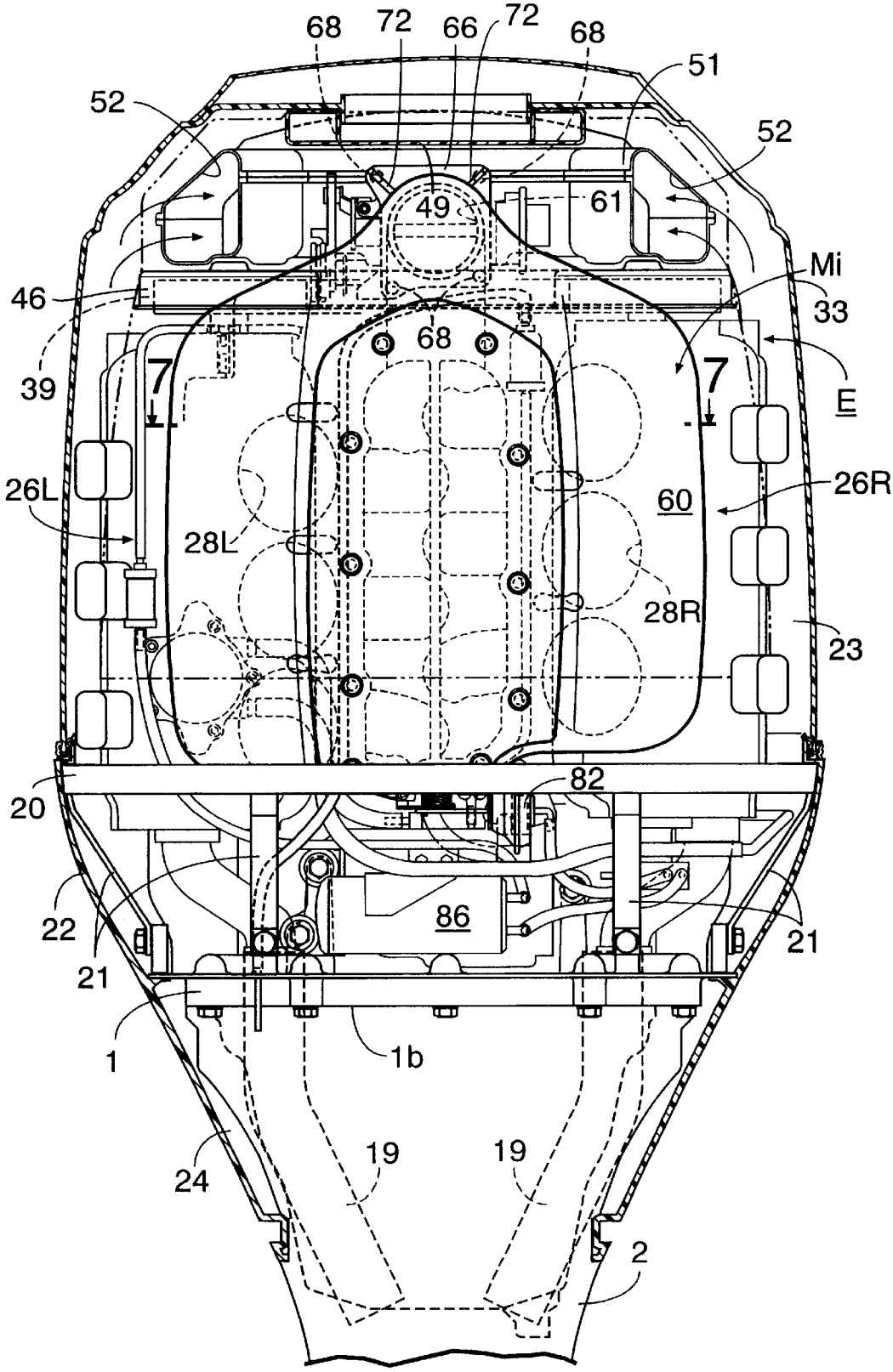
FIG. 5 is a cross section at line 5—5 in FIG. 2.
Figure 6:
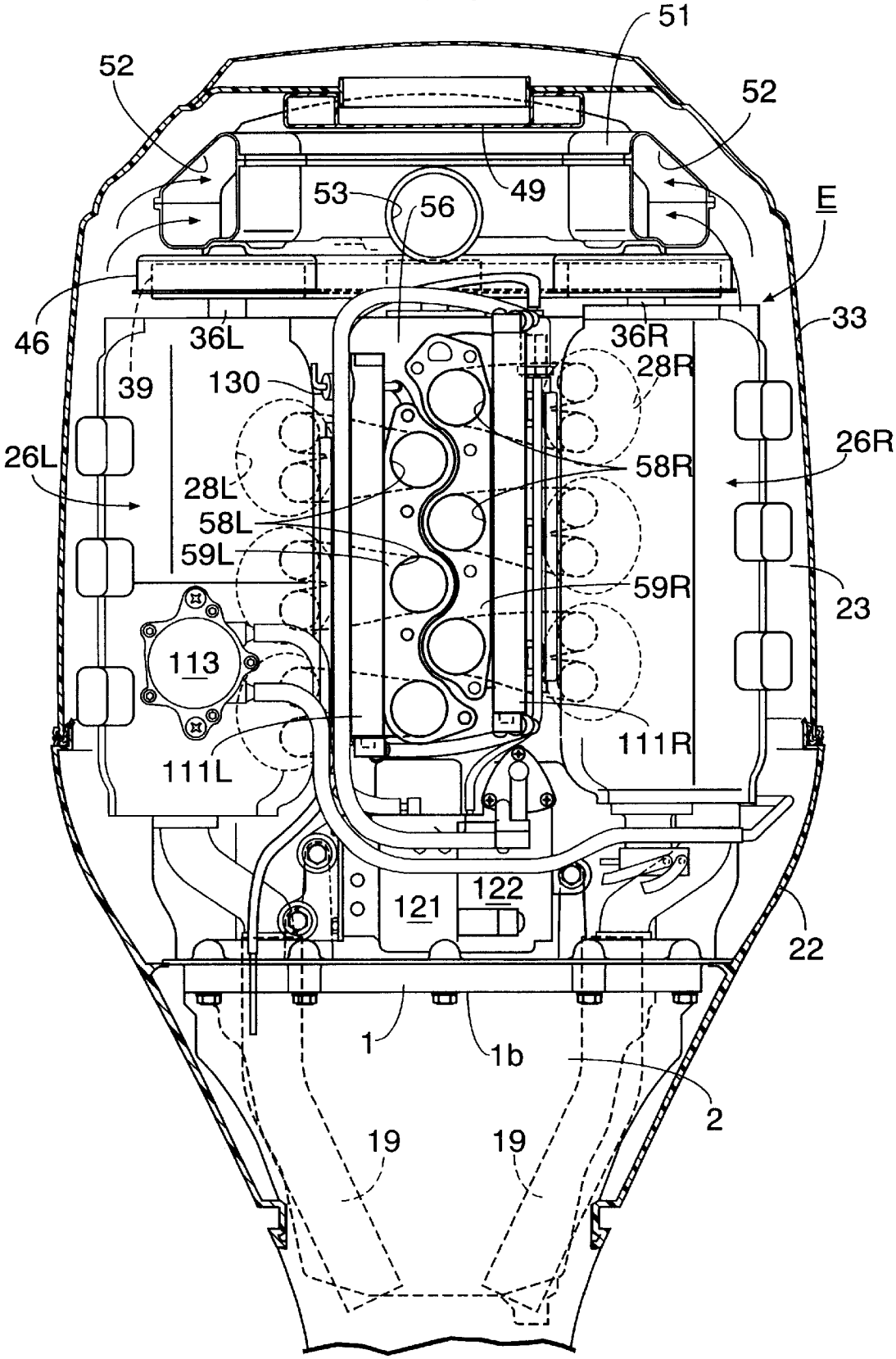
FIG. 6 is a cross section at line 6—6 in FIG. 3.

As shown in FIGS. 5 and 6, each of the banks 26L and 26R is equipped with a plurality of (three in the illustrated example) cylinder bores 28L and 28R in a vertical arrangement. The left and right banks 26L and 26R are bolted to the rear end face of the crankcase 25 and are formed from a cylinder block 28 having the left and right cylinder bores 28L and 28R, a pair of cylinder heads 29L and 29R, which are bolted to the left and right rear end faces of the cylinder block 28 on which the cylinder bores 28L and 28R respectively open, and a pair of head covers 30L and 30R, which are joined to the rear faces of the cylinder heads 29L and 29R so as to close valve-operating chambers formed in the cylinder heads 29L and 29R.

In FIG. 4, pistons 31L and 31R, which are slidably fitted in the corresponding cylinder bores 28L and 28R, are linked to the crankshaft 4 via connecting rods 32L and 32R.

Joined to a lower mounting face 1*b* of the mount case 1 is an oil pan 35 placed within the extension case 2.

Supported rotatably on the left and right cylinder heads 29L and 29R are valve-operating camshafts 36L and 36R, which are parallel to the crankshaft 4. A small diameter first drive pulley 37 is fixed to the upper end of the crankshaft 4, and driven pulleys 38L and 38R are fixed to the upper ends of the left and right camshafts 36L and 36R. A single timing belt 39 is wrapped around these drive and driven pulleys 37, 38L and 38R, and when the crankshaft 4 rotates the first drive pulley 37, thereby drives the driven pulleys 38L and 38R and, accordingly, the camshafts 36L and 36R with a reduction ratio of ½. Disposed between the above-mentioned pulleys 37, 38L and 38R are idle pulleys 40 and 40' and a tension pulley 41, the idle pulleys 40 and 40' guiding the timing belt 39 and the tension pulley 41 imparting a tension to the timing belt 39 while guiding it.

Fixed to the upper end of the crankshaft 4 is a large diameter second drive pulley 42 that is coaxially arranged immediately above the first drive pulley 37. A drive belt 44 is wrapped around the second drive pulley 42 and a driven pulley 43 of a power generator 45 fitted to the front of the crankcase 25. When the crankshaft 4 rotates, the second drive pulley 42 thereby accelerates the driven pulley 43 and, accordingly, the power generator 45.

As shown in FIGS. 2 and 3, a belt cover 46 covering the timing belt 39 and the drive belt 44 is fixed to the upper faces of the cylinder block 28 and the crankcase 25.

In FIG. 1, reference numeral 19 denotes an exhaust pipe communicating with an exhaust port of the engine E. The downstream end of the exhaust pipe opens within the extension case 2. The exhaust gas that has been discharged from the exhaust pipe 19 into the extension case 2 is discharged into water through the hollow part of the boss of the propeller 9.

The intake system of the engine E is now explained by reference to FIGS. 2,3 and 5 to 13.

In FIGS. 2 and 3, a first air inlet 47 is provided in the upper part of the rear face of the engine hood 33. A flat ventilation duct 49 is disposed along the inner face of the rear wall of the engine hood 33 so as to communicate with the first air inlet 47. The lower end of the ventilation duct 49 opens in the lower part of the engine compartment 23. A second air inlet 48 is provided in the lower part of the front of the engine hood 33. Attached to the inner face of the front wall of the engine hood 33 is a partition 64 forming a ventilation passage 50 stretching from the second air inlet 48 to the upper part of the power generator 45.

A box-shaped intake silencer 51 using the rear half of the belt cover 46 to form a part of its bottom wall adjoins the belt cover 46. Provided on the rear wall of the intake silencer 51 are a pair of left and right inlets 52 and an outlet 53 disposed between the inlets 52. Connected to the outlet 53 is the upstream end of an intake path 54*a* of a throttle body 54. Pivotably supported in the intake path 54*a* is a throttle valve 55 operable coupled to an acceleration lever (not illustrated) provided in the hull H.

Figure 7:
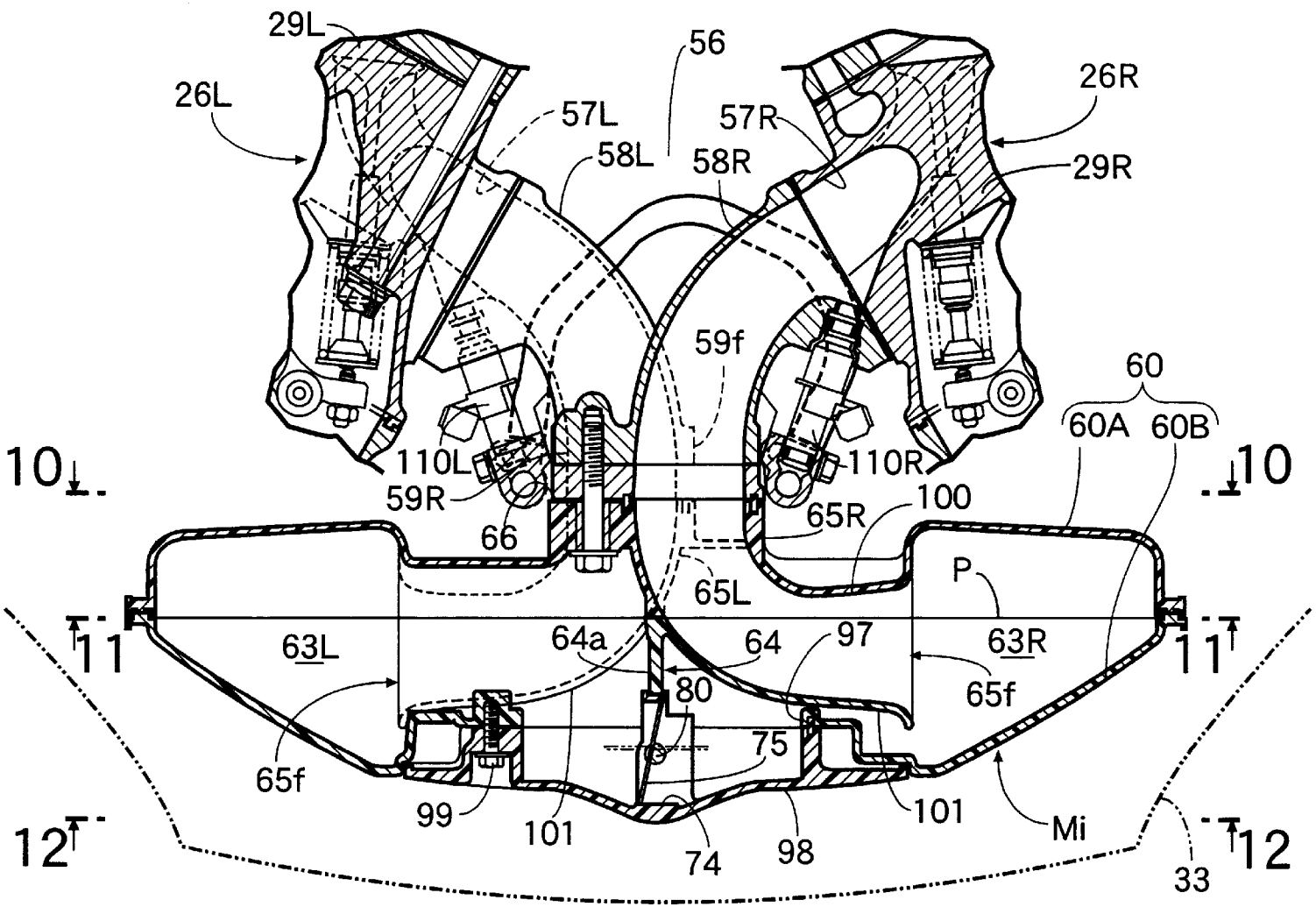
FIG. 7 is a cross section at line 7—7 in FIG. 5.
Figure 8:
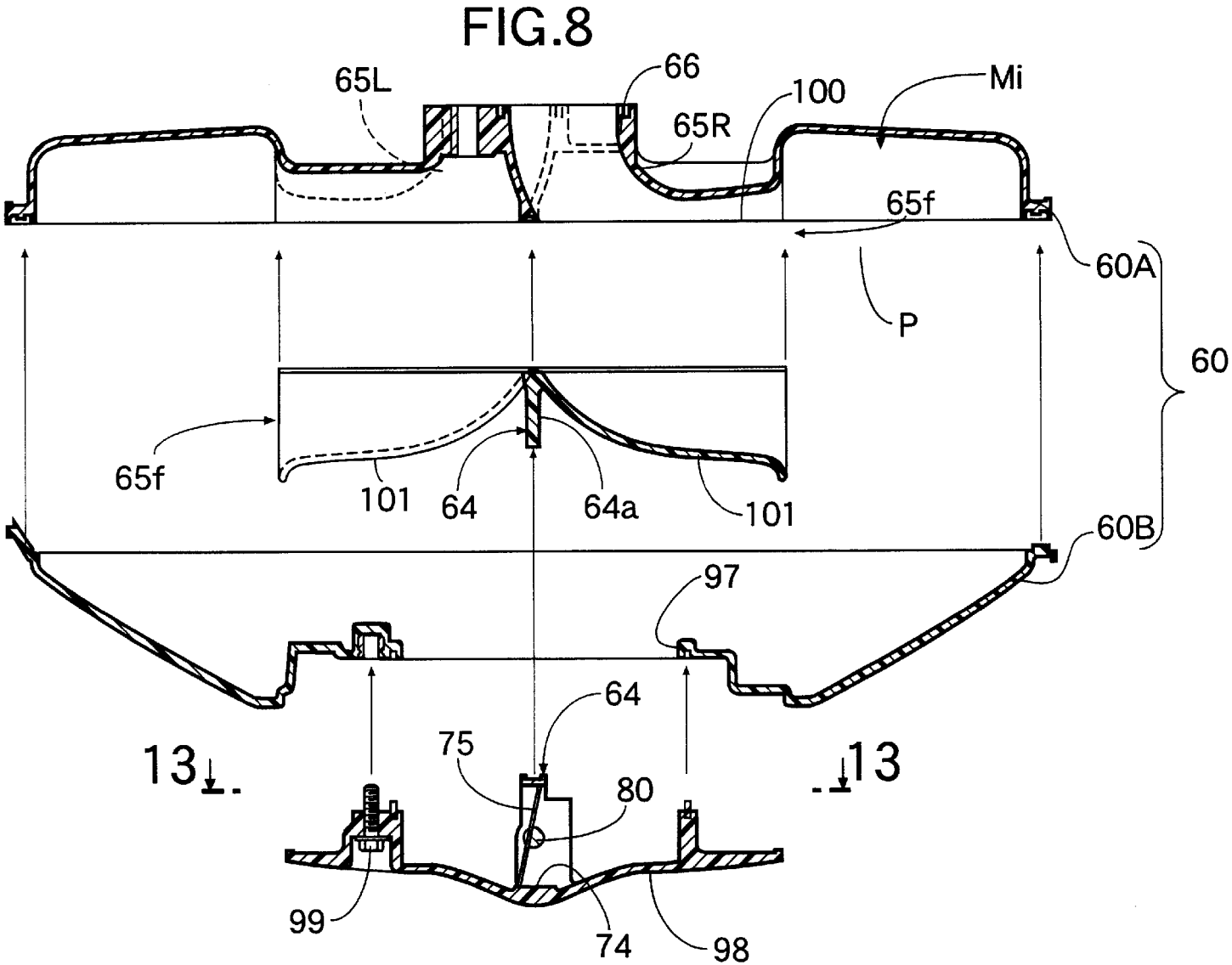
FIG. 8 is an exploded view, corresponding to FIG. 7, of an intake manifold.
Figure 9:
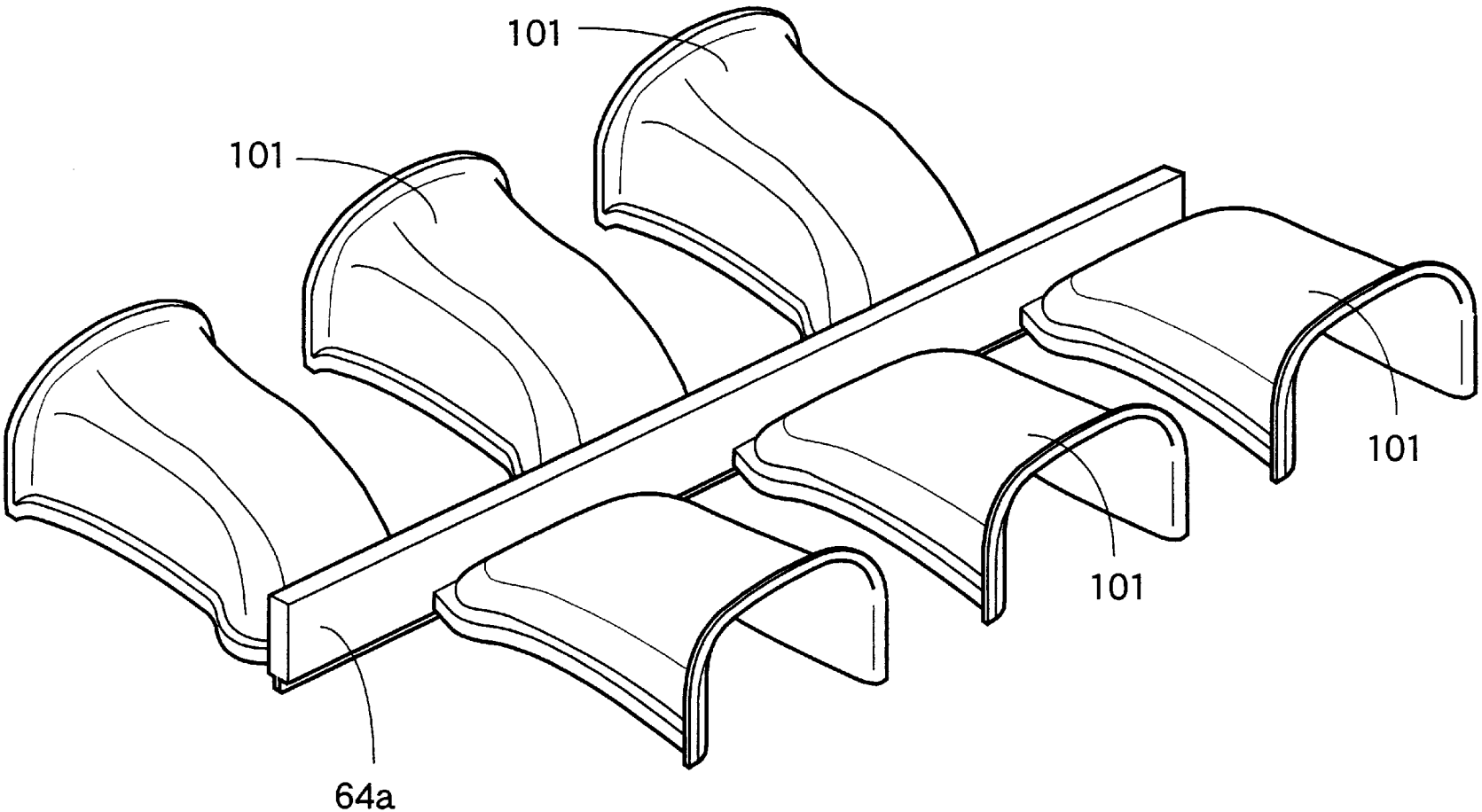
FIG. 9 is a perspective view of a group of funnel segments in the intake manifold.
Figure 10:
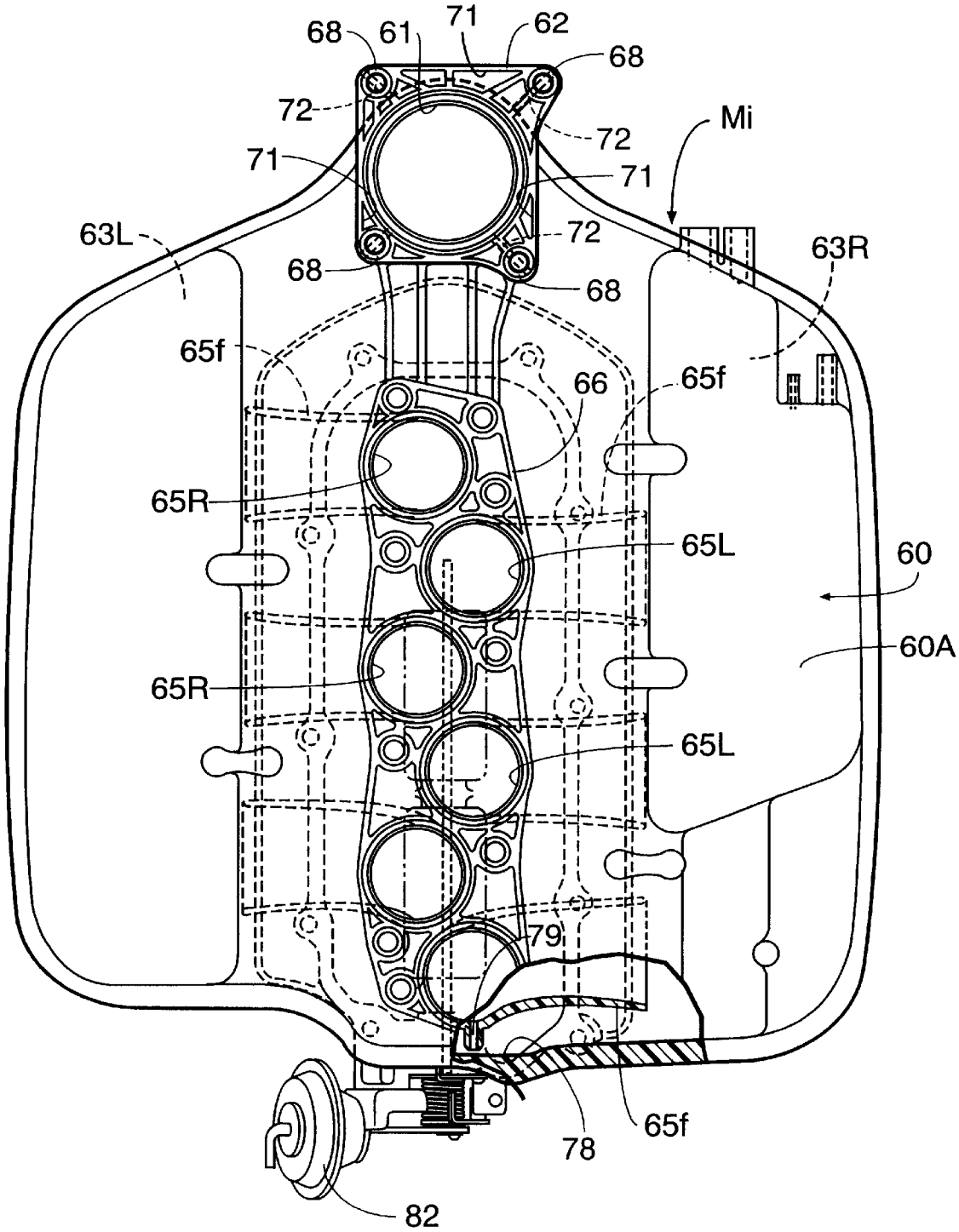
FIG. 10 is a cross section at line 10—10 in FIG. 7.

In FIGS. 5 to 7, an intake manifold Mi is disposed facing a hollow 56 between the left and right banks 26L and 26R. The intake manifold Mi communicates with the downstream end of the intake path 54*a* of the throttle body 54. Disposed in the hollow 56 are a plurality of left intake pipes 58L and a plurality of right intake pipes 58R with their respective upstream ends facing rearward. The plurality of left intake pipes 58L are connected to a plurality of intake ports 57L formed in the cylinder head 29L of the left bank 26L. The plurality of right intake pipes 58R are connected to a plurality of intake ports 57R formed in the cylinder head 29R of the right bank 26R. Formed integrally on the upstream ends of the plurality of left intake pipes 58L is a left connecting flange 59L for connecting the upstream ends to each other. Formed integrally on the upstream ends of the plurality of right intake pipes 58R is a right connecting flange 59R for connecting the upstream ends to each other.

The intake manifold Mi is made of a synthetic resin, has an intake air distribution box 60 having a shape that is long in the vertical direction and flat in the front-and-rear direction, and is disposed to bridge the rear faces of the left and right banks 26L and 26R. A connecting flange 66 having an intake inlet 61 in its central part is formed in the upper part of the front wall of the intake air distribution box 60. A vertically extending partition 64 is provided within the intake air distribution box 60, thereby defining a left distribution chamber 63L and a right distribution chamber 63R individually communicating with the intake inlet 61 within the intake air distribution box 60. A guide wall 67 for splitting the air that has flowed in through the intake inlet 61 between the left and right distribution chambers 63L and 63R is connected to the partition 64.

Formed integrally on the front wall of the intake air distribution box 60 facing the hollow 56 are a plurality of left intake branch pipes 65L and right intake branch pipes 65R communicating with the corresponding left and right distribution chambers 63L and 63R. Formed integrally on the downstream ends of the plurality of left and right intake branch pipes 65L and 65R is one connecting flange 66 connecting together the left and right intake branch pipes 65L and 65R. The connecting flange 66 is bolted to the connecting flanges 59L and 59R of the left and right intake pipes 58L and 58R.

Formed on the upstream ends of the left intake branch pipes 65L are funnels 65*f*, which open leftward within the intake air distribution box 60. Formed on the upstream ends of the right intake branch pipes 65R are funnels 65*f*, which open rightward within the intake air distribution box 60. The respective funnels 65*f* contribute to a reduction in the pipeline resistance of the corresponding intake branch pipes 65L and 65R while maintaining the effective pipe lengths thereof.

In FIGS. 3, and 7 to 10, the connecting flange 62 having the intake inlet 61 has a polygonal shape (square in the illustrated example). A nut 68 is embedded in the front face of each of the corners. A connecting flange 69 formed on the downstream end of the throttle body 54 is superimposed on the front end of the connecting flange 62. The two connecting flanges 62 and 69 are connected to each other by screwing a plurality of bolts 70 running through the connecting flange 69 into the nuts 68.

A plurality of cutout recesses 71 are formed on the front end of the connecting flange 62. Formed integrally on the back of the connecting flange 62 are a plurality of reinforcing ribs 72 extending toward the outer face of the intake air distribution box 60. As a result, the neck of the connecting flange 62 can be reinforced while reducing the weight of the connecting flange 62. In particular, placing the reinforcing ribs 72 at positions corresponding to the embedded nuts 68 is effective in reinforcing the areas of the connecting flange 62 that are connected to the throttle body 54.

The partition 64 defining the left and right distribution chambers 63L and 63R within the intake air distribution box 60 is provided with one or a plurality of valve holes 74 that provide direct communication between the two distribution chambers 63L and 63R. One or a plurality of open/close valves 75 for opening and closing the valve holes 74 are pivotably supported on the partition 64.

When the engine E is in operation, the air that has flowed in through the first air inlet 47 descends the ventilation duct 49, is released into the lower part of the engine compartment 23, and goes upward toward the left and right inlets 52 of the intake silencer 51. At this stage, water droplets that are present in the air are separated and fall, thereby preventing the water droplets from entering the intake silencer 51.

On the other hand, when the power generator 45 is in use, a cooling fan rotates therewithin, the air that has flowed in through the second air inlet 48 rises in ventilation passage 50 and enters through a cooling air inlet 76 in the upper part of the power generator 45, thereby cooling its interior. The air then flows out of cooling air outlets 77 in the lower part of the power generator 45 and also goes toward the left and right inlets 52 of the intake silencer 51.

The air that has entered the left and right inlets 52 is combined within the intake silencer 51, comes out of the outlet 53, passes through the intake path 54*a* of the throttle body 54 and goes toward the intake inlet 61 of the intake air distribution box 60. At this stage, the intake volume of the engine E is controlled by the degree of opening of the throttle valve 55 in the intake path 54*a*.

In a low speed operation region of the engine E, the open/close valves 75 within the intake air distribution box 60 are closed. The air that has flowed in through the intake inlet 61 is split between the left and right distribution chambers 63L and 63R, which extend vertically. The air that has flowed into the left distribution chamber 63L is further split between the plurality of left intake branch pipes 65L and taken into the corresponding cylinder bores 28L via the left intake pipes 58L and the intake ports 57L of the left bank 26L. The air that has flowed into the right distribution chamber 63R is further split between the plurality of right intake branch pipes 65R and taken into the corresponding cylinder bores 28R via the right intake pipes 58R and the intake ports 57R of the right bank 26R.

In the low speed operation region of the engine E, the left distribution chamber 63L and the right distribution chamber 63R, into which open the funnels 65*f* of the left and right intake branch pipes 65L and 65R, are cut off by the closed open/close valves 75 except for that area in the upper part that communicates with the intake inlet 61. As a result, dual resonant supercharge intake systems, which do not interfere with each other in terms of air intake, are formed from an intake system that extends from the left distribution chamber 63L to the intake ports 57L of the left bank 26L and an intake system that extends from the right distribution chamber 63R to the intake ports 57R of the right bank 26R. Moreover, since the natural frequency of each of the resonant supercharge intake systems is set so as to substantially coincide with the open/close cycle of the intake valves of the respective banks 26L and 26R in the low speed operation of the engine E, the resonant supercharge effect can be effectively exhibited, thereby increasing the intake charge efficiency in the low speed operation region of the engine E and improving the output performance.

Furthermore, in a high speed operation region of the engine E, the open/close valves 75 within the intake air distribution box 60 open, and the left and right distribution chambers 63L and 63R communicate with each other via the valve holes 74, thereby forming one large capacity surge tank. Since the funnels 65*f* of the left and right intake branch pipes 65L and 65R open within the surge tank, an adverse effect of the resonance in the resonant intake system can be prevented. That is, the resonant effect obtained in the low-speed operation range of the engine E is eliminated, thereby preventing a delay in intake response. As a result, a predetermined intake air charging efficiency can be secured in the high-speed operation range of the engine E, to thereby enhance the power output performance.

Figure 11:
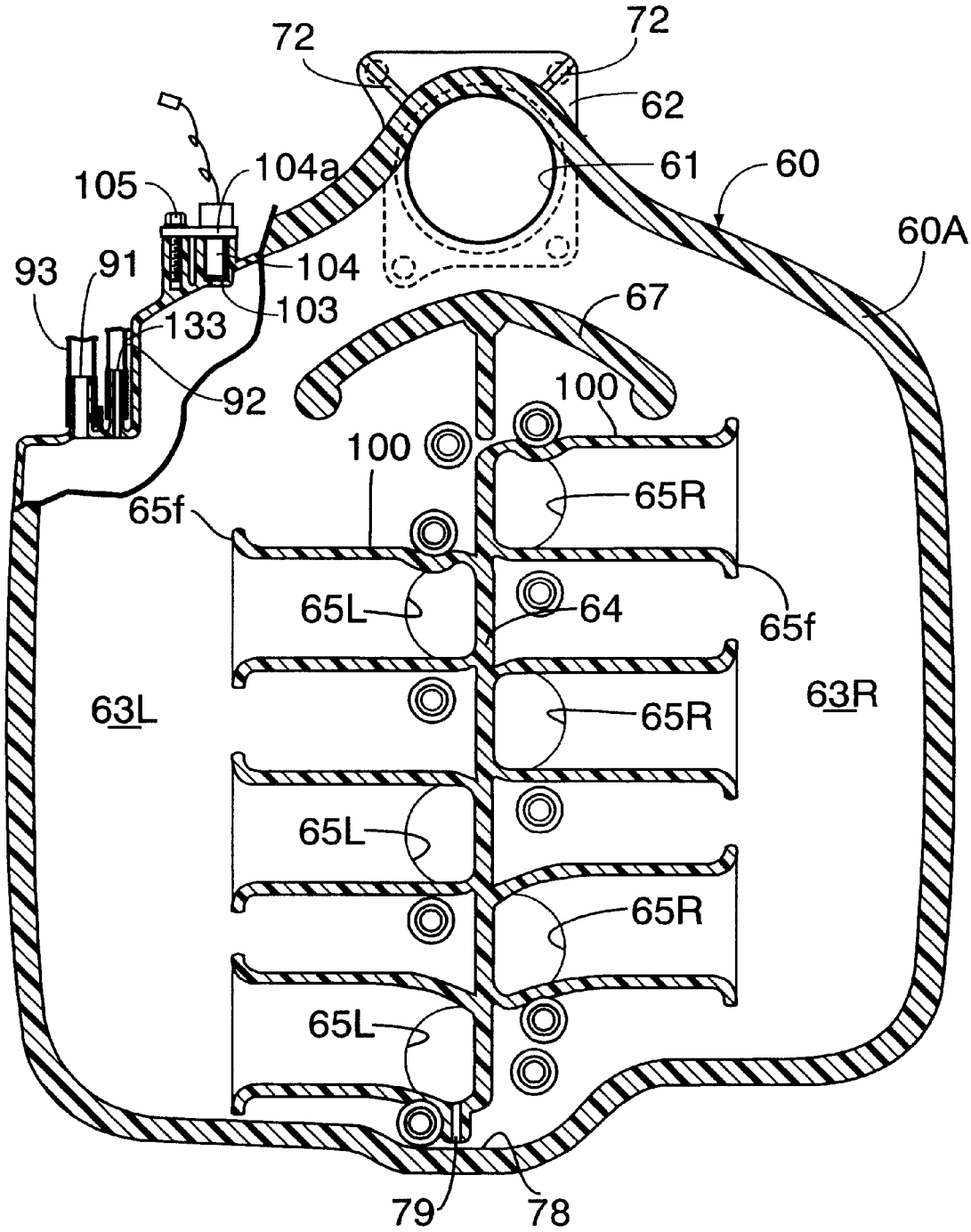
FIG. 11 is a cross section at line 11—11 in FIG. 7.

In FIG. 11, a fuel collector is provided as a recess 78 on the base of the intake air distribution box 60. Provided in the lowest funnel 65*f* is a fuel draw-up hole 79, which extends downward to provide communication between the inner face of the funnel 65*f* and the recess 78. As a result, when the engine E is in operation, even if fuel collects on the base of the intake air distribution box 60, that is, in the fuel collection recess 78 due to the phenomenon of intake air blow-back, when an intake negative pressure is generated in the lowest funnel 65*f*, the fuel draw-up hole 79 draws up the fuel because of the action of the negative pressure and supplies it to the corresponding cylinder bore 28L or 28R, thereby preventing loss of the fuel.

The fuel that has flowed back to the intake air distribution box 60 from the respective intake branch pipes 65L and 65R is reliably held in the recess 78, which functions as a fuel collector, thereby preventing loss due to scattering of the fuel.

Furthermore, the fuel draw-up hole 79 is provided in the lowest funnel 65*f* of the intake branch pipe, among the plurality of vertically arranged intake branch pipes 65L and 65R, and the fuel that has collected in the recess 78 can be drawn up by means of the shortest fuel draw-up hole 79.

Figure 12:
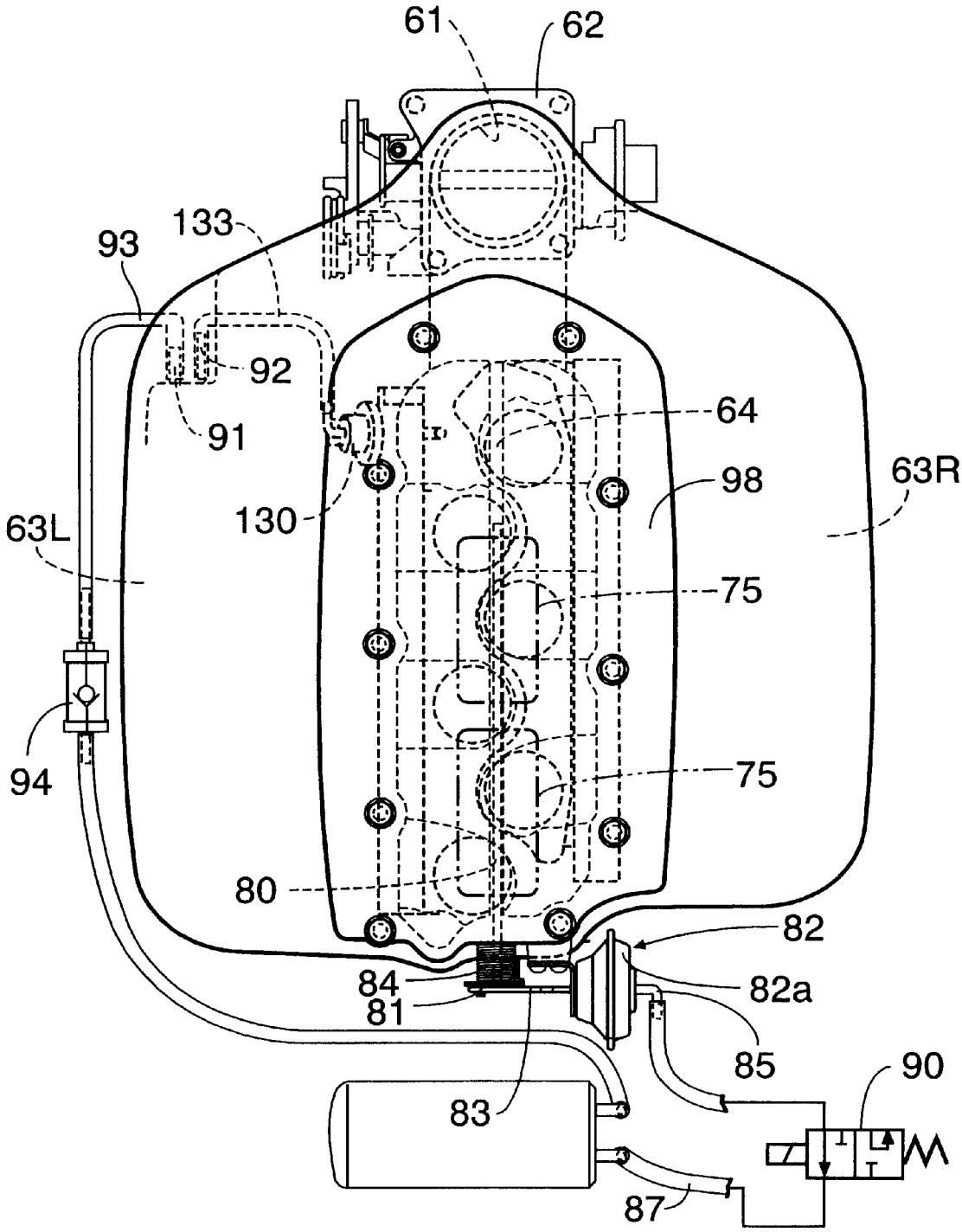
FIG. 12 is a view from line 12—12 in FIG. 7.
Figure 13:
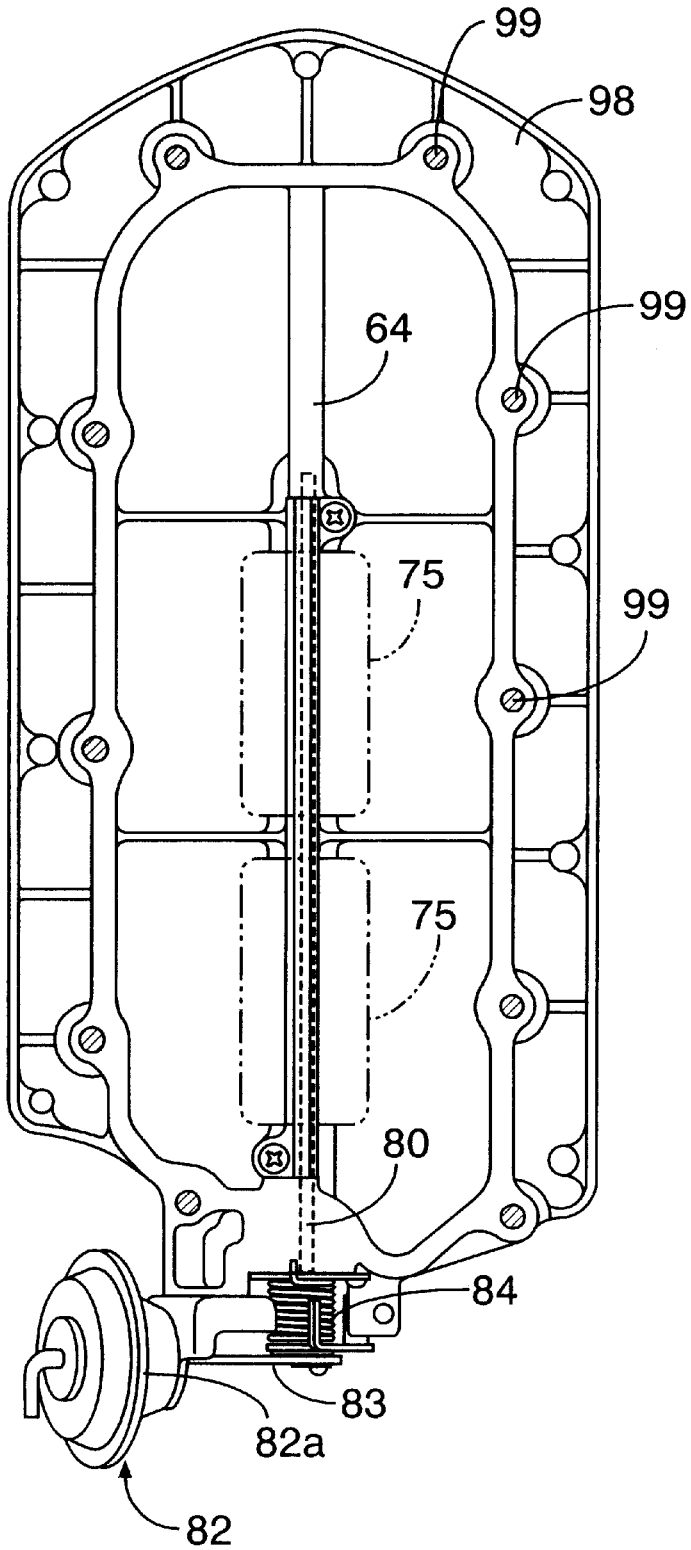
FIG. 13 is a cross section at line 13—13 in FIG. 8.

In FIGS. 12 and 13, a valve shaft 80 fixed to the open/close valves 75 is rotatably supported in the partition 64. An operating lever 81 fixedly provided at one end of the valve shaft 80 is connected to an operating rod 83 of a negative pressure actuator 82 and is urged in a direction in which the open/close valves 75 are opened by a return spring 84 of the operating lever 81. A casing 82*a* of the negative pressure actuator 82 is supported on the outer wall of the intake air distribution box 60. A diaphragm that divides it into a negative pressure chamber and an atmospheric chamber is provided in a tensioned state, within casing 82*a*. When a negative pressure is introduced into the negative pressure chamber, the diaphragm operates to pull the operating rod 83, thereby rotating the operating lever 81 in a direction in which the open/close valves 75 are closed.

A negative pressure inlet pipe 85 communicating with the negative pressure chamber projects from the casing 82*a* of the pressure actuator 82. A control valve 90 is disposed in a negative pressure pipe 87 providing a connection between the negative pressure inlet pipe 85 and the negative pressure tank 86. The control valve 90 is formed from a solenoid valve and controlled by an electronic control unit (not illustrated) so that it is excited when the engine E is in a low speed operation region, thereby unblocking the negative pressure inlet pipe 85, and it is demagnetized when the engine E is in a high speed operation region, thereby blocking the negative pressure inlet pipe 85 and providing a connection between the negative pressure chamber of the negative pressure actuator 82 and the atmosphere. Thus, when the engine E is in a low speed operation region, the negative pressure actuator 82 operates thus closing the open/close valves 75, and when the engine E is in a high speed operation region, the negative pressure actuator 82 is in a non-operating state, and the open/close valves 75 are opened by the biasing force of the return spring 84.

The negative pressure tank 86 is connected to a negative pressure pipe 93 that extends to a first negative pressure extraction pipe 91 formed in the upper part of the intake air distribution box 60. Disposed in the negative pressure pipe 93 is a check valve 94 that prevents backflow of the negative pressure from the negative pressure tank 86 to the intake air distribution box 60 side. When the engine E is in operation, the negative intake pressure generated in the intake air distribution box 60 can therefore be stored in the negative pressure tank 86 via the negative pressure pipe 93 and the check valve 94.

As shown in FIGS. 2 and 4, the negative pressure tank 86 is placed, together with an auxiliary fuel tank 121, which will be described below, in the auxiliary equipment installation space 27 that is between the top of the rear part of the mount case 1 and the left and right banks 26L and 26R.

Referring again to FIGS. 7 to 9, the intake air distribution box 60 is formed from a first box half 60A on the front side relative to a vertical plane P, that is, on the side of the banks 26L and 26R, and a second box half 60B on the rear side, and they are individually molded from a synthetic resin. When molding them, the first box half 60A is molded integrally with the connecting flange 62 having the intake inlet 61. The first and second box halves 60A and 60B are joined to each other by vibration welding along the dividing plane therebetween.

An opening 97 is provided in the central area on the side wall of the second box half 60B. A cover plate 98 for blocking the opening 97 is molded from a synthetic resin. When molding it, the cover plate 98 is molded integrally with one half of the partition 64. The valve holes 74 are formed in said one half, and the open/close valves 75 that open and close the valve holes 74 are mounted on the one half. The cover plate 98 is secured to the second box half 60B by a bolt 99.

The left and right intake branch pipes 65L and 65R are formed from a plurality of intake branch pipe main bodies 100 and funnel segments 101. The intake branch pipe main bodies 100 are molded integrally with the first box half 60A to form parts of the funnels 65*f*. The funnel segments 101 are separated from the intake branch pipe main bodies 100 on the plane P and form the remaining parts of the respective funnels 65*f*. In addition, a connecting body 64*a* forming a part of the partition 64, is molded integrally with all of the funnel segments 101. That is, the group of funnel segments 101 and the connecting body 64*a* are molded as one piece.

When assembling the intake manifold Mi, firstly, the group of left and right intake branch pipe main bodies 100 of the first box half 60A and the group of funnel segments 101 are superimposed on the plane P, pressed together, and welded to each other by vibrating them relative to each other. Subsequently, the first box half 60A and the second half 60B are superimposed on the plane P and welded by vibration in the same manner. After that, the cover plate 98 is fitted to the second box half 60B and secured by the bolt 99.

Since the first box half 60A and the second box half 60B, and the group of intake branch pipe main bodies 100 and the group of funnel segments 101 are thus welded by vibration in the plane P, each member can be molded easily and, when welding them, the pressure imposed can be reliably leveled over the entire welded surfaces, thereby achieving uniform welding margins and stabilizing the weld strength. As a result, the productivity and quality of the intake manifold Mi can be enhanced. The plurality of funnel segments 101 are connected to each other as one piece via the connecting body 64*a*, which is a part of the partition 64. The group of funnel segments 100 can therefore be molded in a single step together with the connecting body 64*a*, and they can be easily welded by vibration to the group of intake branch pipe main bodies 100.

Moreover, the intake air distribution box 60, which is flat in the front-and-rear direction, is arranged in the vicinity of the rear end faces of the left and right banks 26L and 26R. The groups of left and right intake branch pipes 65L and 65R are arranged to project into the hollow 56 between the left and right banks 26L and 26R. It is therefore possible to place the intake manifold Mi in a small space between the two banks 26L and 26R and the rear wall of the engine hood 33, thereby enhancing the space efficiency of the engine compartment 23 and suppressing any increase in the dimensions of the engine hood 33.

Since the open/close valves 75 are pivotably supported on the part of the partition 64, the partition 64 being integral with the cover plate 98, after forming an assembly having the cover plate 9 and the open/close valves 75, fixing the cover plate 98 to the intake air distribution box 60 can efficiently assemble the intake air distribution box 60 equipped with the open/close valves 75.

In FIG. 11, a negative pressure detection hole 103 is provided in the top wall of the intake air distribution box 60 to open within the intake air distribution box 60. A negative intake pressure sensor 104 is fitted into the negative pressure detection hole 103. A mounting plate 104*a* of the negative intake pressure sensor 104 is fixed to the top wall of the intake air distribution box 60 by a bolt 105. An output terminal of the negative pressure sensor 104 is connected to a lead that is linked to an electronic control unit (not illustrated) for controlling the fuel injection volume, the ignition timing, etc. of the engine. The negative intake pressure detected by the negative intake pressure sensor 104 is therefore employed for controlling the fuel injection volume, the ignition timing, etc.

Since the negative intake pressure sensor 104 fitted into the negative pressure detection hole 103 directly detects the negative intake pressure generated within the intake manifold Mi, the responsiveness of the negative intake pressure sensor 104 to a change in the negative intake pressure of the engine can be enhanced. Moreover, the interior of the intake manifold Mi can function as a surge tank, thus smoothing the engine intake pulsations and thereby allowing the negative intake pressure sensor 104 to detect the negative intake pressure precisely. Furthermore, since, unlike the conventional arrangement, it is unnecessary to employ a long negative pressure pipe, the ease of assembly and maintenance of the engine can be enhanced.

Since the lead connected to the negative intake pressure sensor 104 is very thin, it does not degrade the ease of assembly and maintenance of the engine.

Next, the fuel supply system is explained by reference to FIGS. 7 and 14 to 16.

Attached to the left and right intake pipes 58L and 58R of the banks 26L and 26R are solenoid type fuel injection valves 110L and 110R that inject fuel into the intake valves of the corresponding banks 26L and 26R. Attached to the plurality of fuel injection valves 110L on the left side is a left long fuel rail 110L for supplying fuel thereto. Attached to the plurality of fuel injection valves 110R on the right side is a right long fuel rail 110R for supplying fuel thereto. The left and right fuel rails 111L and 111R are connected to each other at their lower ends by a connecting pipe 112.

One head cover 30L is equipped with a primary fuel pump 113 that is driven mechanically by the camshaft 6L. A first fuel pipe 114 provides a connection between the intake port of the primary fuel pump 113 and, via a joint 115, a fuel-bearing pipe 117 that extends from the fuel tank 116 placed on the hull H side. Disposed in the first fuel pipe 114 are, from the upstream side, a first fuel filter 118 and a second fuel filter 119. The first fuel filter 118 removes moisture from the fuel, and the second fuel filter 119 removes other foreign substances from the fuel.

The discharge port of the primary fuel pump 113 is connected to the fuel inlet of the auxiliary fuel tank 121 via a second fuel pipe 120. Provided within the auxiliary fuel tank 121 is a known float valve that blocks the fuel inlet when the fuel oil level within the auxiliary fuel tank 121 becomes equal to or exceeds a predetermined level. When the engine E is in operation, the auxiliary fuel tank 121 is filled with a constant amount of fuel that is drawn up from the main fuel tank 116 by means of the primary fuel pump 113. Attached to one side of the auxiliary fuel tank 121 is a secondary fuel pump 122 that draws up the fuel within the tank 121. The discharge port of the secondary fuel pump 122 is connected to the upper end of the right fuel rail 110R via a third fuel pipe 123. High pressure fuel that has been discharged from the secondary fuel pump 122 therefore enters the right fuel rail 110R from its upper end side, then passes through the connecting pipe 112, enters the left fuel rail 110L from its lower end side, and is supplied to the respective fuel injection valves 110L and 110R. In this way, the left and right fuel rails 111L and 111R and the connecting pipe 112 together form a U-shaped fuel passage, thus making it difficult for air bubbles to build up in the fuel passage and thereby stabilizing the amount of fuel injected from each of the fuel injection valves 110L and 110R.

Figure 16:
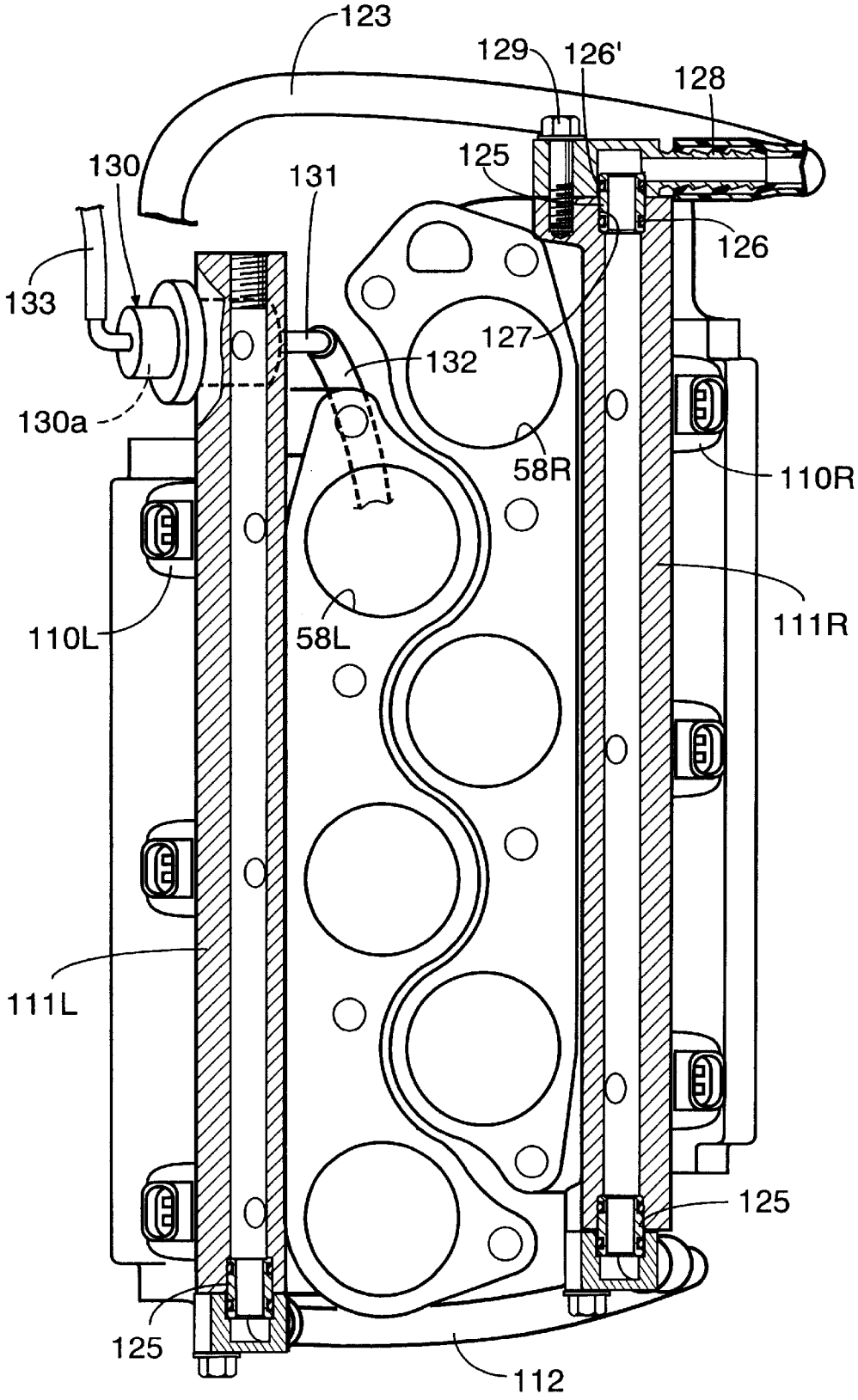
FIG. 16 is a longitudinal cross section of a fuel rail.

Joints 125 are used to connect the fuel rails 111L and 111R, and the third fuel pipe 123 and connecting pipe 112 as shown in FIG. 16. That is, the joint 125 has a hollow cylindrical shape, and a pair of seals 126 and 126' are attached to the outer circumference of opposite ends thereof. One end of the joint 125 is fitted in an expansion hole 127 so that one seal 126 is in close contact with the inner circumference of the expansion hole 127 at one end of the fuel rail 111L or 111R. The other end of the joint 125 is fitted in a terminal pipe 128 connected to the end of the third fuel pipe 123 or the connecting pipe 112, so that the other seal 126' is in close contact with the inner circumference of the terminal pipe 128. The terminal pipe 128 has a mounting plate 128*a*, which is fixed to the corresponding fuel rails 111L and 111R by a bolt 129. Such a connection arrangement makes it possible for the fuel rails 111L and 111R, and the third fuel pipe 123 and the connecting pipe 112 to be connected to each other easily and reliably.

The upper end of the left fuel rail 111L is closed, and a fuel pressure adjusting device 130 is attached to the upper end. The fuel pressure adjusting device 130 adjusts the pressures within the two fuel rails 111L and 111R, that is to say, the fuel injection pressures of the respective fuel injection valves 110L and 110R. Its surplus fuel outlet pipe 131 is connected to a fuel return pipe 132 with the far end opening within the auxiliary fuel tank 121. The fuel that is considered to be surplus by the fuel pressure adjusting device 130 is therefore returned to the auxiliary fuel tank 121 through the fuel return pipe 132. The fuel pressure adjusting device 130 has a negative pressure chamber 130*a* for controlling the fuel injection pressure in response to the negative intake pressure of the engine E, that is, the load of the engine E. The negative pressure chamber 130*a* is connected to the second negative intake pressure extraction pipe 92 (FIG. 11) of the intake distribution box 60 via a negative pressure pipe 133.

The top wall of the auxiliary fuel tank 121 is connected to an air vent pipe 134 communicating with the space above the fuel oil level within the auxiliary fuel tank 121. The air vent pipe 134 firstly extends upward, then bends in an inverted U-shape in the upper part of the engine E, and opens into the annular empty chamber 24 (FIG. 5) of the under cover 22. A fuel vapor capture device 135, which is formed from a filtering material, is disposed in the upward route of the air vent pipe 134.

The interior of the auxiliary fuel tank 121 breathes through the air vent pipe 134, the fuel vapor thereby generated within the auxiliary fuel tank 121 is captured by the fuel vapor capture device 135, and the liquefied fuel is returned to the auxiliary fuel tank 121.

Figure 14:
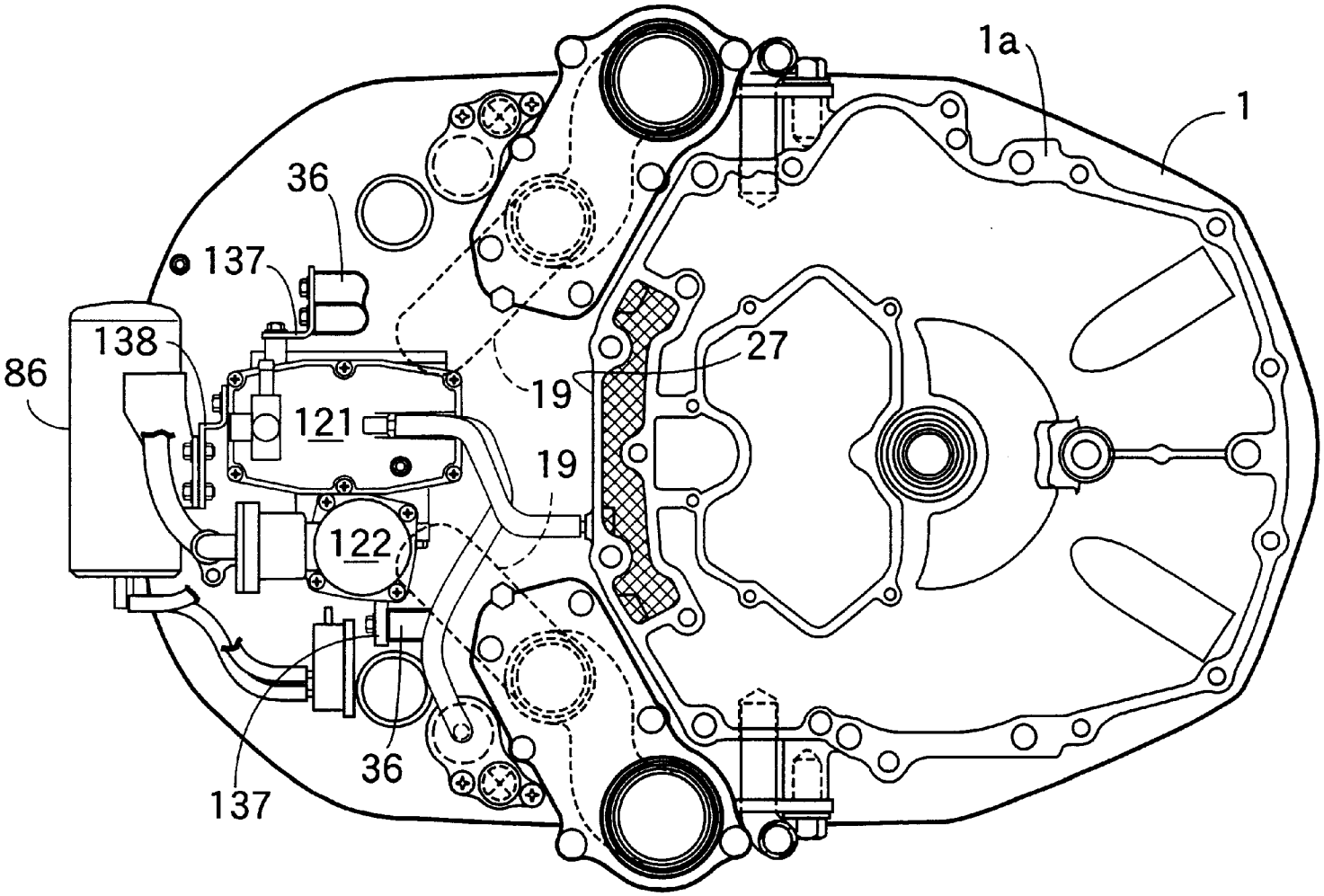
FIG. 14 is a cross section at line 14—14 in FIG. 2.
Figure 15:
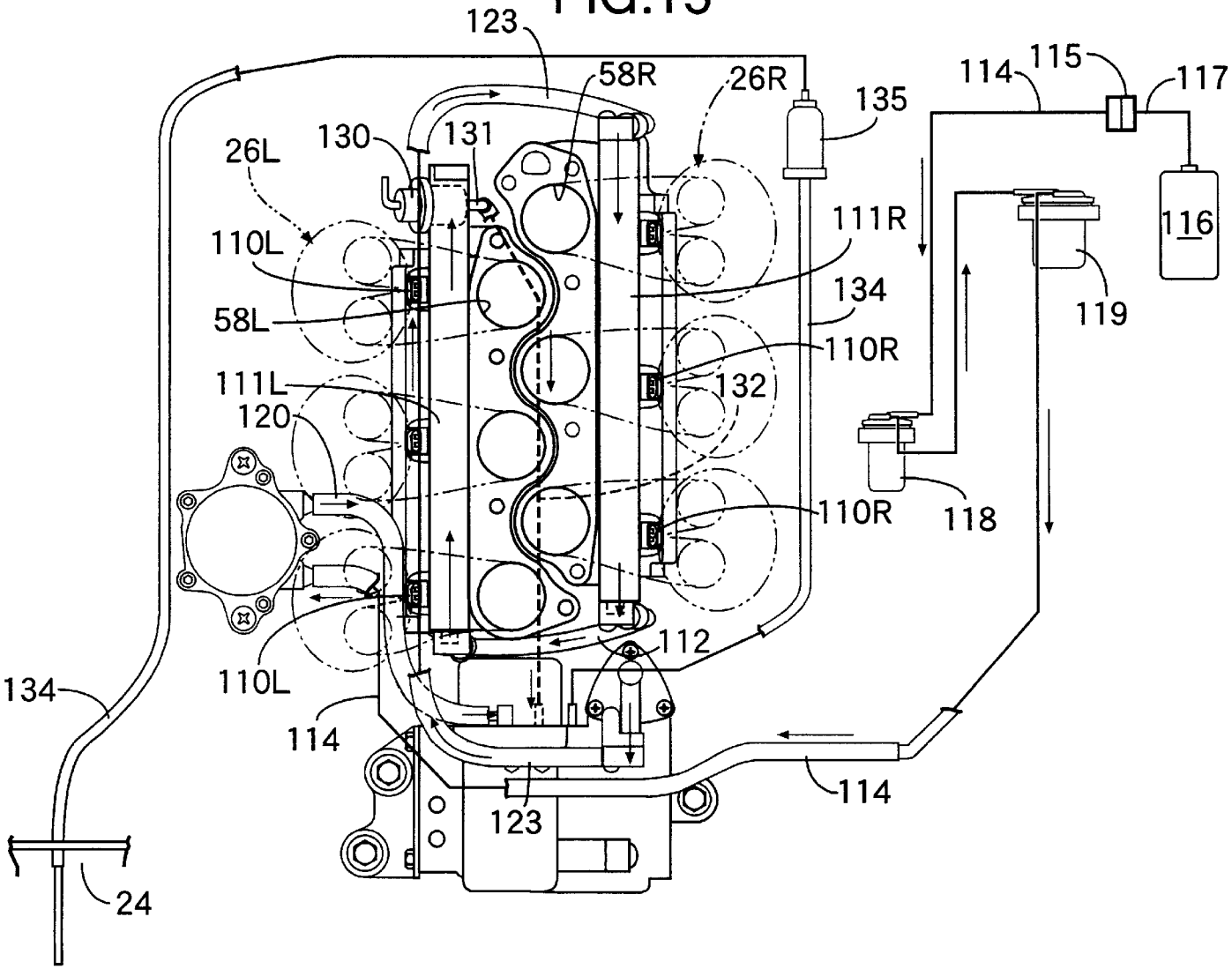
FIG. 15 is a diagram of the entire fuel supply system.

The auxiliary fuel tank 121 and the secondary fuel pump 122 are supported by a plurality of posts 136 projectingly provided on the top of the mount case 1 via brackets 137 within the supplementary equipment installation space 27 (FIGS. 2 and 14). The negative pressure tank 86 is supported on the rear face of the auxiliary fuel tank 121 via a bracket 138.

Since the intake manifold Mi is disposed in the hollow 56 between the left and right banks 26L and 26R, and the auxiliary fuel tank 121 and the secondary fuel pump 122 are disposed in the supplementary equipment installation space 27 beneath the left and right banks 26L and 26R, this arrangement allows the engine compartment 23 to have a comparatively small capacity and be made compact.

Moreover, the auxiliary fuel tank 121 and the secondary fuel pump 122 positioned beneath the left and right banks 26L and 26R receive little heat from the left and right banks 26L and 26R, thereby minimizing the generation of fuel vapor.

Furthermore, since the auxiliary fuel tank 121 and the secondary fuel pump 122, which are connected to each other, form one assembly, its handling becomes easy.

Moreover, since the assembly is supported by the posts 136 of the mount case 1, the assembly can be supported by a small number of posts 136, that is to say, the support structure for the auxiliary fuel tank 121 and the secondary fuel pump 122 can be simplified.

Moreover, since the auxiliary fuel tank 121 and the secondary fuel pump 122 do not make contact with the left and right banks 26L and 26R, it is possible to avoid the conduction of heat from the respective banks 26L and 26R to the auxiliary fuel tank 121 and the secondary fuel pump 122, thereby preventing overheating of the fuel therewithin.

As described above, in accordance with the present invention, an outboard motor includes, in an engine compartment defined by an engine hood, an engine, an intake manifold including a plurality of intake branch pipes connected to a plurality of intake ports of the engine, and a throttle body connected to an intake inlet of the intake manifold. Further, a negative pressure detection hole that opens within the intake manifold is provided in the outer wall of the intake manifold, and a negative intake pressure sensor fixed to the outer wall, is fitted in the negative pressure detection hole. Therefore, the negative intake pressure sensor directly detects the negative intake pressure generated within the intake manifold, thereby enhancing the responsiveness of the negative intake pressure sensor to a change in the negative intake pressure of the engine. Moreover, the interior of the intake manifold functions as a surge tank, thereby leveling the intake pulsations of the engine, and as a result the negative intake pressure sensor can detect the negative intake pressure precisely. Furthermore, since it is unnecessary to employ a long connecting hose, the ease of assembly and maintenance of the engine can be enhanced.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. A negative intake pressure detection system in an outboard motor having an engine, an engine hood and an engine compartment defined by the engine hood, the negative pressure detection system comprising:

an intake manifold mounted on the engine, comprising a plurality of intake branch pipes connected to a plurality of intake ports of the engine;

a throttle body connected to an intake inlet of the intake manifold;

a negative pressure detection hole opening within the intake manifold in an outer wall of the intake manifold; and a negative intake pressure sensor fixed to the outer wall and positioned in the negative pressure detection hole.

* * * * *